United States Patent [19]

Broadbent

[11] Patent Number: 5,042,576

[45] Date of Patent: Aug. 27, 1991

[54] LOUVERED FIN HEAT EXCHANGER

[75] Inventor: John A. Broadbent, St. Louis Park, Minn.

[73] Assignee: Heatcraft Inc., Dallas, Tex.

[21] Appl. No.: 464,643

[22] Filed: Jan. 10, 1990

Related U.S. Application Data

[63] Continuation of Ser. No. 7/344,548, Apr. 24, 1989, abandoned, which is a continuation of Ser. No. 7/230,737, Aug. 10, 1988, abandoned, which is a continuation of Ser. No. 7/061,880, Jun. 11, 1987, abandoned, which is a continuation of Ser. No. 6/808,661, Dec. 10, 1985, abandoned, which is a continuation of Ser. No. 6/549,485, Nov. 4, 1983, abandoned.

[51] Int. Cl.[5] ..... F28F 1/32; F28D 1/04

[52] U.S. Cl. ..... 165/151; 165/181; 165/182; 165/903; 165/906

[58] Field of Search ..... 165/151, 181, 182, 906, 165/903

[56] References Cited

U.S. PATENT DOCUMENTS

| | | | |
|---|---|---|---|
| 1,887,036 | 11/1932 | Modine | 165/151 |
| 2,252,211 | 8/1941 | Seemiller | 165/151 |
| 2,427,336 | 9/1947 | Askin | 165/151 |
| 2,557,760 | 6/1951 | Powell et al. | 165/182 |
| 2,834,583 | 5/1958 | Oldberg et al. | 165/151 |
| 2,965,357 | 12/1960 | Modine | 165/151 |
| 3,135,320 | 6/1964 | Forgo | 165/151 |
| 3,438,433 | 4/1969 | Gunter | 165/151 |
| 3,916,989 | 11/1975 | Harada et al. | 165/151 |
| 4,434,844 | 3/1984 | Sakitani et al. | 165/151 |

FOREIGN PATENT DOCUMENTS

| | | | |
|---|---|---|---|
| 0156781 | 7/1952 | Australia | 165/151 |
| 0128063 | 5/1932 | Austria | 165/151 |
| 1212901 | 3/1960 | France | 165/151 |
| 2398279 | 3/1979 | France | 165/151 |
| 57-690 | 5/1982 | Japan | 165/151 |

OTHER PUBLICATIONS

Kuethe & Chow, *Foundations of Aerodynamics=Bases of Aerodynamic Design* 3rd Ed.; Wiley & Sons, pp. 87–89, 1976.

Li, Wen-Hsiung; Lam, Sau-Hai; *Principles of Fluid Mechanics*, Addison-Wesley; London, 1964, pp. 115–117.

*Primary Examiner*—John Ford

*Attorney, Agent, or Firm*—Allegretti & Witcoff, Ltd.

[57] ABSTRACT

A finned tube heat exchanger having an improved flat louver fin configuration for increased heat transfer efficiency and low air pressure drop. The fins comprise generally planar sheet metal plates having a pattern of spaced apertures for receiving a group of heat exchanger tubes perpendicularly to the fin plate. Groups of louvers are formed as elongate strips extending generally in an area between adjacent tubes. The strips are selectively offset, i.e. raised or lowered from the nominal plane of the fin, so as to establish a louver pattern having flat louvers in a number of different planes each parallel to the direction of flow of air across the fin. Stiffness is provided for the fin plate by providing a slope and offset of the leading and trailing edges of the fin plate such that they are displaced in a direction parallel to the axes of the tube. Preferably the ends of the louvers are positioned and angled to be tangent to flow streamlines around the circumference of the tubes to present minimum obstruction to flow.

6 Claims, 2 Drawing Sheets

FIG. 1
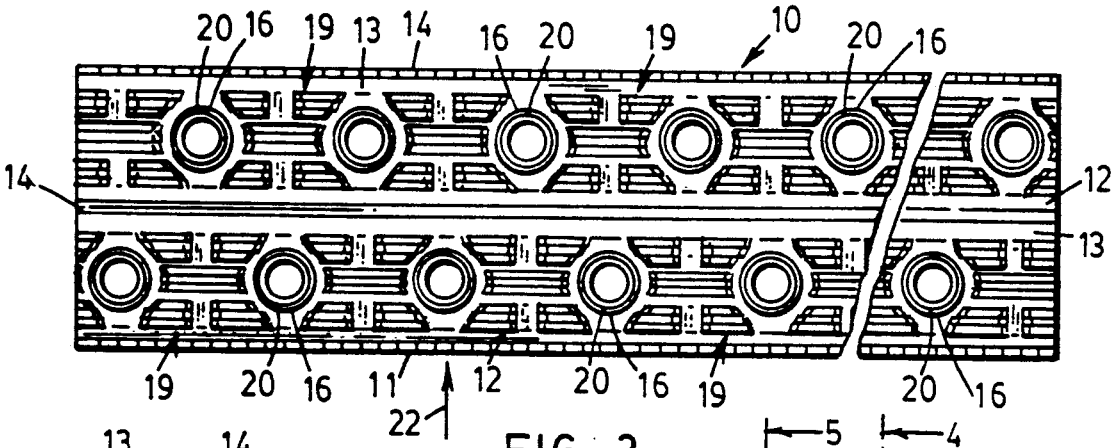
FIG. 2
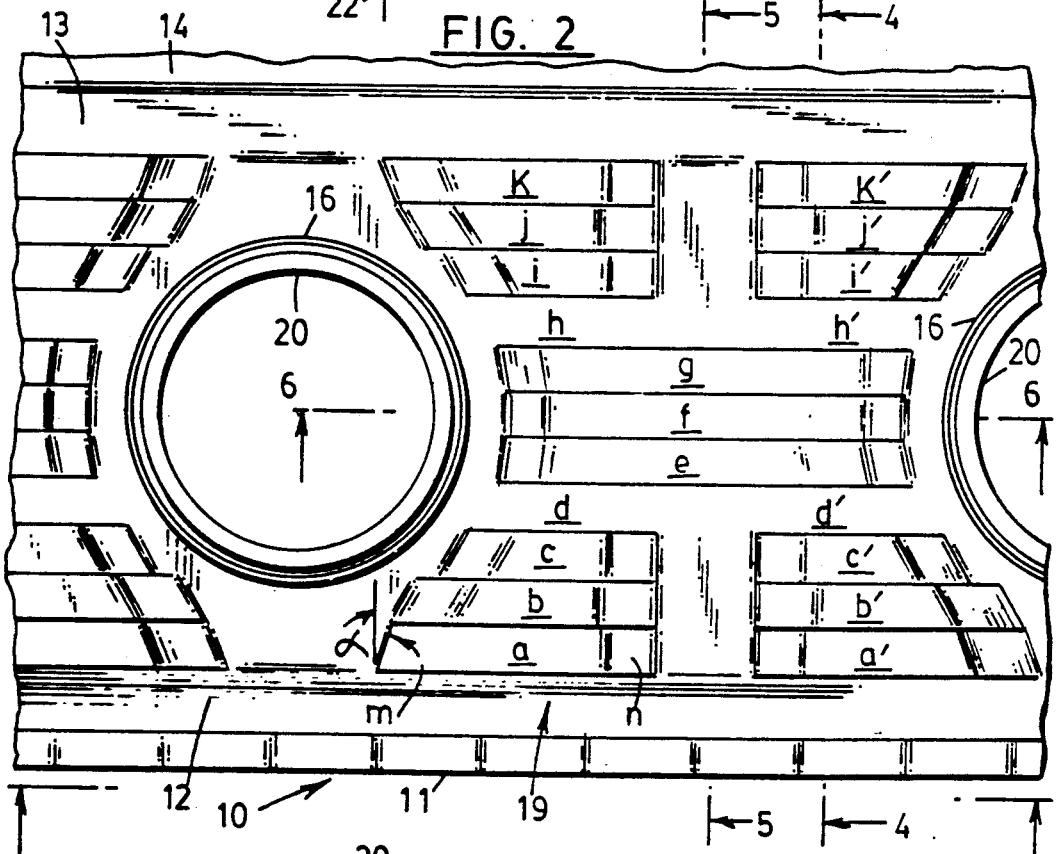
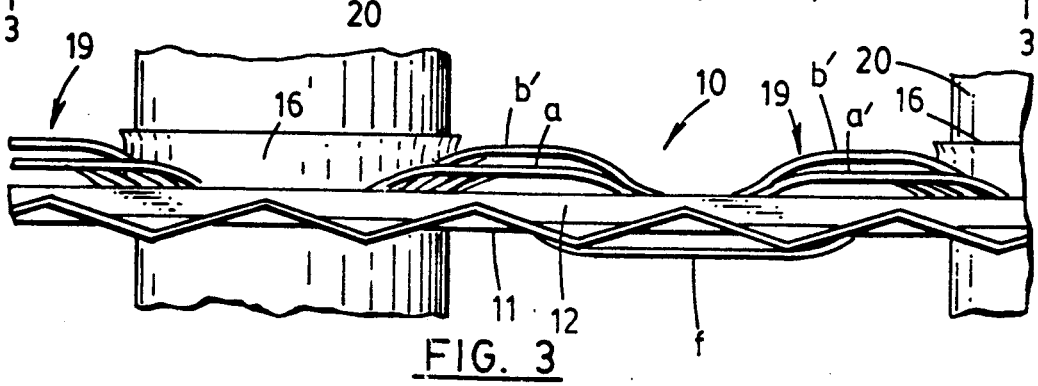
FIG. 3

10
13
14
K'
j'
20
16
h'
g
f
e
d'
c'
b'
a'
19
12
11
17

10
14
13
19
K
j
20
16
h
g
f
e
d
c
b
a
12
11

10
16
j'
19
h'
g
f
h
i
j
13

LOUVERED FIN HEAT EXCHANGER

This application is a continuation of application Ser. No. 07/344,548, filed Apr. 24, 1989, which is a continuation of application Ser. No. 07/344,548, , filed Aug. 10, 1988, which is a continuation of application Ser. No. 07/061,880, filed June 11, 1987, which is a continuation of application Ser. No. 06/808,661, filed Dec. 10, 1985, which is a continuation of application Ser. No. 06/549,485, filed Nov. 4, 1983 all now abandoned.

TECHNICAL FIELD OF THE INVENTION

This invention pertains to the field of finned tube heat exchangers, and more particularly to an improved fin configuration for increasing heat transfer efficiency.

BACKGROUND OF THE INVENTION

Finned tube heat exchangers are widely used in a variety of applications in the fields of refrigeration, air conditioning and the like. Such heat exchangers consist generally of a plurality of spaced parallel tubes through which a heat transfer fluid such as water, oil, air or a refrigerant is forced to flow while a second heat transfer fluid such as air is directed across the tubes. To improve heat transfer a plurality of fins comprising thin sheet metal plates are placed on the tubes. Each fin plate has a plurality of apertures through which the tubes pass generally at right angles to the fin, and a large number of the fins are arranged in parallel, closely spaced relationship along the tubes to form multiple paths for the air or other heat exchange fluid to flow across the fins and around the tubes. The tubes and plates are provided with a suitable mechanical and thermal bond, for example by expansion of the tubes after assembly of the fin plates, to provide good thermal conduction.

A great number of different fin designs for heat exchangers have been proposed in the prior art in the continual search for efficiency, compactness and manufacturing and operating economy. Since the fins are so important in the overall heat transfer of the heat exchanger, even a small increase in the heat transfer coefficient between the surface of the fin and the surrounding airstream or other heat transfer fluid can have an important beneficial effect on overall heat exchanger performance. Numerous fin designs have been proposed in the prior art using various techniques to increase the heat transfer coefficient. Fins such as those proposed in U.S. Pat. Nos. 3,397,741 and 3,438,433 improve efficiency by interrupting the fin plate with a number of short, flat louvers raised up from the plane of the fin, to cause numerous disruptions of the hydrodynamic boundry layers which form with increasing thickness along the fins and decrease heat transfer coefficient. From the standpoint of boundry layer disruption, the greatest improvement would be to have as large a number of very short louvers as possible. Unfortunately, such an approach leads to practical problems of weakness of the resulting thin sheet metal fin plate and this is very undesirable since it makes assembly of the heat exchanger difficult. U.S. Pat. No. 4,365,667 proposes solving this problem by adding stiffening corrugations to each of the louvers formed in the fin plate. The corrugations help stiffen each louver and also the entire fin plate. In addition, the corrugations in the louvers have the effect of turning the airstream. While turning the airstream does provide higher heat transfer than a straight air flow, it does not do it as efficiently, with regard to air pressure drop, as does repeatedly breaking the boundry layer with short, flat louvers. Thus the fin design proposed in the above mentioned patent solves the problem of increasing the heat transfer efficiency of the heat exchanger, but at the expense of increased air pressure drop. Since there is a cost involved in forcing the air across the fins of the heat exchanger, the air pressure drop is an important factor in the overall efficiency of a system using the finned tube heat exchanger.

Despite the progress which has been made in the field, there is still a need for a finned tube heat exchanger with increased heat transfer efficiency while maintaining the air pressure drop as low as possible. At the same time it is important to provide a certain degree of stiffness in the heat exchanger fins to simplify and speed up assembly and manufacturing procedures.

SUMMARY OF THE INVENTION

This invention provides a finned tube heat exchanger meeting the objectives of improved efficiency, low pressure drop in the fluid flow across the fins, and sufficient rigidity to facilitate assembly, through the provision of a fin of novel configuration.

According to this invention, the improved fin for a finned tube heat exchanger comprises a generally planar sheet metal plate having a pattern of spaced apertures for the heat exchanger tubes to pass with their axes perpendicular to the plane of the fin plate. Groups of louvers are formed in the fin plate in areas thereof generally between tube apertures, with each group including elongate, flat louvers which are selectively offset, i.e. raised or lowered, from the nominal plane of the fin so as to lie in planes parallel to the direction of the flow of air or other fluid across the fins. Individual strip louvers are raised or lowered by differing amounts such that the resulting louver pattern has louvers in a number of different planes for each fin plate.

Longitudinal stiffness for the fin plate is provided by providing an overall corrugation to the fin plate so that it slopes toward the leading and trailing edges of the fin plate such that they are displaced in a direction parallel to the axis of the tubes, preferably in an amount of about 0.02 inches or more.

According to another aspect of the invention, the ends of the louvers which are raised or lowered from the nominal plane of the fin are angled to correspond with air flow around the tubes to thereby present minimum obstruction to flow.

These and other features of the invention will be apparent from the following detailed description.

BRIEF DESCRIPTION OF THE DRAWING

In the drawing, FIG. 1 is a plan view of a fin according to the present invention for a two tube row heat exchanger;

FIG. 2 is a plan view of a portion of the fin of FIG. 1, at an enlarged scale;

FIG. 3 is a view taken generally along line 3—3 of FIG. 2;

DETAILED DESCRIPTION OF THE PREFERRED EMBODIMENT

Figure 4:
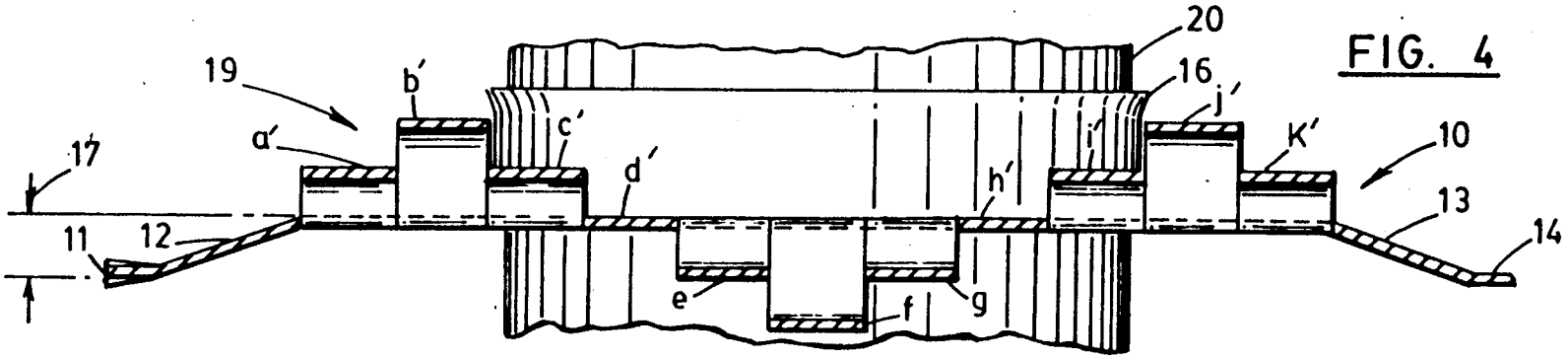
FIG. 4 is a sectional view taken generally along line 4—4 of FIG. 2.

Louvered fin heat exchangers according to the present invention can be made having a single row of tubes or any number of rows of tubes as may be desired for a given application. FIG. 1 shows a two-row heat exchanger, but it will be understood that this is by way of example only and not by way of limitation. A plurality of tubes 20 are arranged in parallel spaced relationship, and a number of fins, one of which is visible in FIG. 1 and indicated by reference number 10, are mounted crossways to the tubes and have apertures through which the tubes 20 pass. The fins have flanges 16 at each tube aperture, as is generally known, for contacting the tubes and spacing the fins from one another in assembly. The tubes in the heat exchanger FIG. 1 are arranged in two rows, with the rows offset so that with respect to a direction of airflow across the fins indicated by arrow 22, the tubes in succeeding rows are positioned behind the gaps between adjacent tubes of preceding rows. A thermally conductive bond is provided between the tubes 20 and fin 10 at the apertures by any suitable means, for example by expanding the tubes slightly after assembly of the fins on the tubes to tightly engage the fins.

Groups or patterns of louvers, indicated generally by reference number 19 in FIG. 1, are provided between adjacent tubes. The term "louver" as used herein includes flat louvers, such as those in group 19, which are generally parallel to the airflow rather than angled or twisted with respect to airflow. Each group 19 of louvers comprises a number of individual thin elongate strip louver sections formed by providing a number of spaced parallel slits in the fin extending in a direction generally between adjacent tubes and transverse to the nominal airflow direction 22, and elevating or depressing individual louvers thus formed above or below the nominal plane of the fin. Specifically, with reference to FIGS. 2 and 3, individual louvers a through k are formed in each group as generally elongate flat thin strips of the fin formed by providing a number of parallel slits in the fin. Some of the louvers, for example e, f and g, extend the full width of the pattern. Others, for example a and a', are split into pairs on either side of an unslitted portion of the fin. This is done primarily in consideration of mechanical strength properties of the long louvers, which are relatively fragile and prone to damage. In the preferred embodiment shown, louvers a, b, c, i, j and k are split, with their corresponding paired louver being indicated by references a', b' . . . k'. If desired, one or more of louvers e, f, g could be split, or one or more of the louvers which are split in FIG. 2 could be a single long louver. In any case, the principle of operation will be the same, but it is believed that the embodiment of FIG. 2 provides a useful blend of efficiency and durability.

Louvers d, d' and h, h' are formed by the slits between them and their respective adjacent louvers, and these louvers, in the preferred embodiment, are left in the nominal plane of the fin rather than being raised above or below it. The remaining louvers are offset from the plane at the fin plate by elevating or depressing them by different amounts above or below the nominal plane of the fin, as seen, for example, in the cross sectional views.

The central portion of each louver is essentially a flat elongate strip parallel to the nominal plane of the fin plate and parallel to the free airstream direction. End or transition portions of the louvers are bent to join and connect with the fin. For example, in FIGS. 2 and 3 louver a is seen as having a central flat elongate portion, and a pair of end or transition portions m and n, at either end. They are formed integrally with louver a by the slits on either side then are creased upwardly (in the case of louver a) at an angle to displace louver a at the desired height. The other louvers have similar end or transition portions but they are not marked with reference numerals in FIG. 2 for the sake of clarity of the drawing.

To minimize air pressure drop across the fin, the end or transition portions of the louvers adjacent the tubes are positioned and angled around the tube apertures in a pattern approximating an airflow streamline around the tube. Specifically, the position of end portion m and the angle alpha in FIG. 2, and the corresponding positions and angles for the ends of the other louvers, are positioned to be tangent to the local flow streamlines. These streamlines are calculated using the following equation based on two-dimensional, incompressible, inviscid flow between two parallel cylinders:

$$\frac{U}{V} = \left\{ Y - R^2 \left[ \left( \frac{(Y-Z)}{X^2 + (Y-Z)^2} \right) + \left( \frac{(Y+Z)}{X^2 + (Y+Z)^2} \right) \right] \right\}$$

where U equals the stream function, V equals the free stream velocity, R equals the outside radius of the fin collar around the tube, Z equals half the distance between the tube centers, and where the streamlines are defined by lines of constant U/V. X and Y denote the coordinates of points in the fins where X increases in the direction of air flow and Y increases in a direction perpendicular to the airflow (and X). The origin (X=0, Y=0) is defined as being directly between the tube center of two adjacent tubes within the same row.

The X, Y coordinates of any single point, such as $X_1$, $Y_1$, establish a U/V ratio such as $V/V_{X1,Y1}$. For any X, such as $X_2$, with U/V set at $U/V_{X1,Y1}$ the equation yields a value of Y such as $Y_2$ which, by premise of the equation, lies on the same streamline. Streamlines may be plotted using the equation, and lance end portions may be fixed tangent to the plotted streamlines.

Reference number 11 in FIG. 2 is the leading edge of the fin, for an assumed direction of airflow, and reference 14 shows the back edge of one row or pattern. In the case of a single row heat exchanger, edge 14 would be the trailing edge of the fin; in the case of a multiple row, edge 14 would be the back edge of one pattern which would adjoin continuously with the leading edge of the next pattern. An overall corrugation is impressed in the fin by offsetting the leading and trailing edges from the nominal plane of the fin plate. Portion 12 of the fin slopes from the offset leading edge 11 to the nominal plane of the fin, or the portion of the fin where it meets the tubes. Similarly, portion 13 slopes from the nominal plane to back edge 14. It will be understood that the slope and the offset could be provided in either direction from the plane. The leading and back edges are offset from the nominal plane of the fin by these sloped portions by a dimension indicated by reference number 17. The amount of offset is chosen in connection with the dimensions and thickness of the fin in order to give the desired degree of stiffness. In the preferred embodiment, the fins are of aluminum having a thickness in the range of 0.0045 inches, and the offset 17 is at least 0.02 inches and preferably 0.03 inches displacement in a direction perpendicular to the nominal plane of the fin, or parallel to the axis of the tubes. The offset thus provided increases the moment of inertia of the fin and therefore its longitudinal stiffness over that of a predominantly flat fin with louvers. This provides needed strength and resistance to bending to facilitate assembly.

An edge ripple can be provided at the leading edge and trailing edge of the fin, as seen for example in FIGURES 2 and 3 which show an edge ripple applied to leading edge 11. Edge rippling is generally known in the art and is sometimes used to make the fins somewhat more resistant to damage during handling. The use of an edge ripple in conjunction with this invention is optional; it is not necessary, but can be used if desired.

The leading edge 11 is bent parallel to the oncoming free airstream and to the nominal plane of the fin by a crease formed between edge 11 and slope portion 12. A similar crease is formed between the back edge 14 and slope portion 13, which is repeated for each pattern and row in a multiple row fin. The crease thus formed forms a "rain gutter" or path for the condensate to drain down along. This is important in a dehumidifying use of the heat exchanger to prevent water droplets which condense on the fin and the louvers from being blown to the downstream edges and carried free of the louver into the airstream. That would be unacceptable in a dehumidifying application since there is typically no provision for water removal in the ducts downstream of the heat exchanger. However, the leading and trailing edge corrugation and crease provides a path for removing the condensate.

Figure 5:
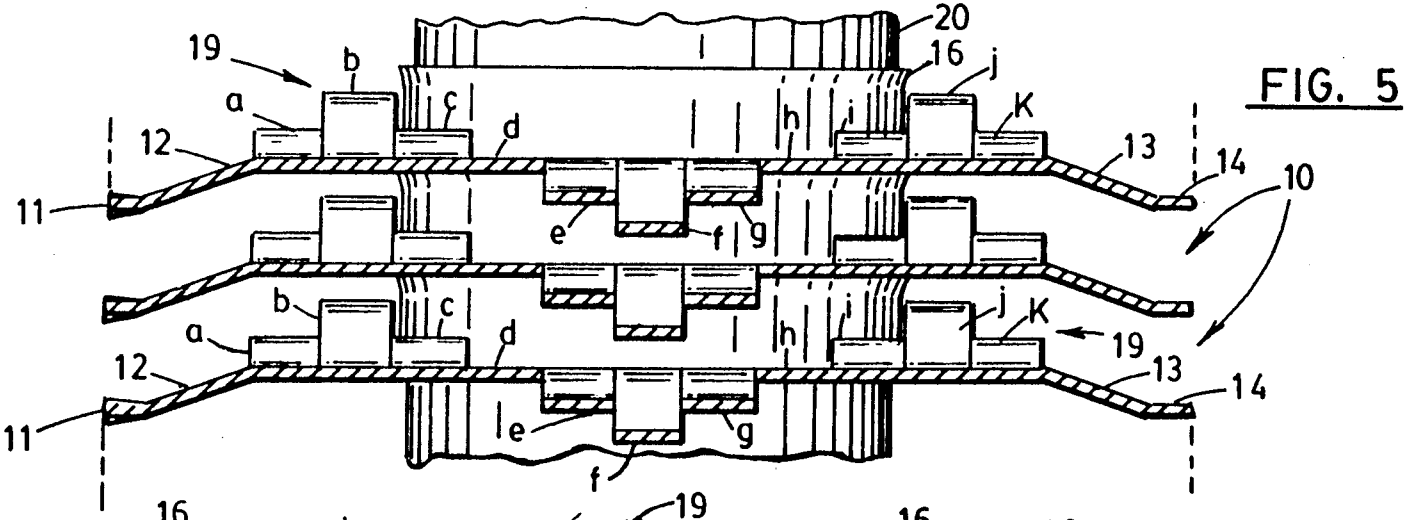
FIG. 5 is a sectional view taken generally along line 5—5 of FIG. 2.
Figure 6:
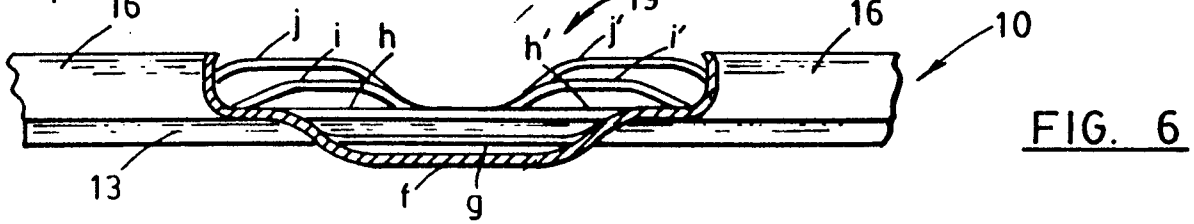
FIG. 6 is a sectional view taken generally along line 6—6 of FIG. 2.

As seen in the cross sectional views FIGS. 4 and 5, the individual thin strip louvers are staggered from one another by providing different offset directions and amounts. Specifically, each louver is preferably at a different offset from the immediately preceding louver and preferably from any of the several immediately preceding louvers. This allows air to diffuse in velocity and temperature after leaving one louver before it engages the next downstream louver at the same offset. Preferably this is achieved by providing at least five different levels or offsets of louvers, and establishing a pattern to achieve the above-noted objective.

In operation, as the free airstream encounters the fin, it will be divided by the individual louvers and flow across them. It is well known that as air flows across a fin of a heat exchanger, or a louvered portion of a fin, a hydrodynamic boundary layer forms which decreases the heat transfer coefficient between the fin and the airstream. The boundary layers tend to form at a leading edge of engagement with the airstream and increase in thickness with distance of flow across the fin. By having many short louvers on the fin, the boundary layers are repeatedly disrupted and caused to restart, thus keeping the overall average boundary layer thin and providing higher heat transfer coefficients.

Although short louvers do disrupt the boundary layer and cause it to restart on the next downstream louver, the energy imparted to the airstream may not be completely diffused when the air hits the next downstream louver. The first louver on a thin plate of a finned tube heat exchanger will be contacted by air which is at the temperature and free stream velocity of the incoming air. However, a louver which is directly behind the first louver will be contacted by air which has been changed in temperature and reduced in velocity. However, if the upstream and downstream louvers are far enough apart, the air temperature and velocity will equalize with the surrounding airstream.

When louvers are contacted by air whose temperature and velocity have not yet equalized with the surrounding airstream, they will transfer less heat due to the reduced temperature difference between the air and the fin surface and the lower velocity of the air. In the present invention, by placing the louvers at a number of different offset levels, a large number of the louvers will be contacted by airstreams which are at the incoming air temperature and free stream velocity. Further, the multiple level offsetting increases the distance that air travels from the downstream end of one louver to the leading edge of the next louver giving a greater opportunity for temperature and velocity to equalize before reaching the next louver. Thus, by providing a large number of louvers and offsetting them at different levels, greater heat transfer is achieved.

Since the overall efficiency of a heat exchanging unit depends not only on the rate of heat transfer, but also on the cost of forcing air through the unit, it is very important to maintain a low pressure drop across the heat exchanger. This is accomplished in the present invention by keeping the louvers flat and parallel to the direction of air flow. While putting corrugations in the individual louvers would turn the air and cause an increase in the rate of heat transfer, it would also cause a disproportionate increase in the air pressure drop across the unit, therefore decreasing overall efficiency. The necessary strength for the fin plate is provided by the overall leading and trailing edge slope and offset. This allows sufficient strength for ease of assembly without damaging the fins which would otherwise be rather weak and fragile since they are made of very thin metal stock.

What is claimed:

1. A finned tube heat exchanger comprising:

a plurality of closely spaced parallel fin plates;

a plurality of heat transfer tubes passing through the fin plates generally perpendicular thereto in at least a row and secured in heat conductive relationship thereto to provide heat transfer between a first fluid circulating through the tubes and a second fluid flowing across and between the fin plates, the second fluid flowing in a nominal fluid flow direction, and flowing in local flow directions as it passes around the circumference of the tubes, the nominal fluid flow direction defined as a single direction irrespective of the local flow directions, the tubes defining tube centers;

said fin plates having fin collars around the heat transfer tubes and groups of louvers formed in the areas generally between adjacent tubes through which the second heat exchange fluid flows;

said groups of louvers comprising elongate strips systematically formed between a number of slits formed in the fin plates perpendicular to the nominal fluid flow direction of flow of the second fluid;

selected ones of said strips offset from the nominal plane of the fin plate by end portions of the strips which are shaped to position the intermediate portions thereof parallel to the nominal plane of the fin plate and displaced from the fin plate in a direction parallel to the axes of the tubes, with individual strips offset in different directions and amounts, in the direction parallel to the axes of the tubes, to provide a staggered pattern of flat louvers;

the end portions of said strips adjacent the tubes being formed at angles to be substantially tangent to local flow streamlines of the second fluid as it passes around the circumference of the tubes systematically according to a formula of substantially constant U/V, where the formula is $U/V=(Y-R^2(-((Y-Z)/(X^2+(Y-Z)^2))+((Y+Z)/(X^2+(Y+Z)^2))))$, where R equals the outside radius of the fin collars, Z equals half the distance between the heat transfer tube centers, X denotes a coordinate of points in the fin where X increases in the direction of airflow and Y denotes a coordinate of points in the fin where Y increases in a direction perpendicular to the airflow and to the X direction, where the origin (X=0, Y=0) is defined as being directly between tube centers of two adjacent tubes within the same row, and where the formula is solved for values of X, Y of constant U/V at which to locate points along the end portions of said strip; and leading and trailing edges of said fin with respect to the direction of fluid flow thereacross offset from the nominal plane of the fin plate in a direction parallel to the tube axes, the fin having sloped portions extending to the offset leading and trailing edges, the offset thereby providing an overall corrugation to increase stiffness of the fin.

2. A finned tube heat exchanger according to claim 1 wherein the amount of said offset of the leading and trailing edges of the fin from the plane of the fin plate is at least 0.02 inches.

3. A finned tube heat exchanger, comprising:

a plurality of closely spaced parallel fin plates;

at least one row of heat transfer tubes passing through the fin plates generally perpendicular thereto and secured in heat conductive relationship thereto to provide heat transfer between a first fluid circulating through the tubes and a second fluid flowing across and between the fin plates, the second fluid flowing in a nominal fluid flow direction, and flowing in local flow directions as it passes around the circumference of the tubes, the nominal fluid flow direction defined as a single direction irrespective of the local flow directions, the tubes defining tube centers;

said fin plates having fin collars around the heat transfer tubes and groups of louvers formed in the areas generally between adjacent tubes of a row through which the second heat exchange fluid flows;

said groups of louvers comprising elongate strips systematically formed between a number of slits formed in the fin perpendicular to the nominal fluid flow direction of flow of the second fluid;

selected ones of said strips offset from the nominal plans of the fin plate by end portions of the strips which are formed to position the intermediate portions of the strips parallel to the fluid direction and to the nominal plane of the fin plate, with individual strips offset in different directions and amounts, in the direction parallel to the axes of the tubes, to produce a staggered pattern of flat louvers;

the end portions of said strips adjacent the tubes being formed at angles to be substantially tangent to local flow streamlines of the second fluid as it passes around the circumference of the tubes systematically according to a formula of substantially constant U/V, where the formula is $U/V=(Y-R^2-((Y-Z)/(X^2+(Y-Z)^2))+((Y+Z)/(X^2+(Y+Z)^2))))$, where R equals the outside radius of the fin collars, Z equals half the distance between the heat transfer tube centers, X denotes a coordinate of points in the fin where X increases in the direction of airflow and Y denotes a coordinate of points in the fin where Y increases in a direction perpendicular to the airflow and to the X direction, where the origin (X=O, Y=0) is defined as being directly between tube centers of two adjacent tubes within the same row, and where the formula is solved for values of X, Y of constant U/V at which to locate points along the end portions of said strips; and said fin plates having sloped portions adjacent the areas thereof which are between tubes of a row and which have said louvers, said sloped portions extending in upstream and downstream directions, respectively, with respect to the direction of flow of said second fluid so that the leading edge of the upstream sloped portion and the trailing edge of the downstream sloped portion are offset from the nominal plane of the fin plate in the area between the tubes so as to provide an overall corrugation to the fin to increase its stiffness.

4. A finned tube heat exchanger according to claim 3 wherein said trailing edge of the downstream sloped portion of the fin plates for one row of tubes is adjacent the leading edge of the upstream sloped portion for the next row of tubes.

5. A finned tube heat exchanger according to claim 3 wherein said sloped portions have narrow strips at said leading edge and said trailing edge which are bent parallel to the nominal plane of the fin.

6. A finned tube heat exchanger according to claim 3 wherein the amount of said offset of the leading and trailing edges of the fin from the plane of the fin plate is at least 0.02 inches.

* * * * *